US005414401A

United States Patent [19]

Roshen et al.

[11] Patent Number: 5,414,401

[45] Date of Patent: May 9, 1995

[54] HIGH-FREQUENCY, LOW-PROFILE INDUCTOR

[75] Inventors: Waseem A. Roshen, Clifton Park; Alexander J. Yerman, Scotia, both of N.Y.

[73] Assignee: Martin Marietta Corporation, East Windsor, N.J.

[21] Appl. No.: 838,656

[22] Filed: Feb. 20, 1992

[51] Int. Cl.[6] ..... H01F 17/06; H01F 27/30

[52] U.S. Cl. ..... 336/178; 336/200; 336/212; 336/223; 336/225

[58] Field of Search ..... 336/232, 200, 178, 212, 336/83, 223, 225

[56] References Cited

U.S. PATENT DOCUMENTS

| | | | |
|---|---|---|---|
| 3,273,099 | 9/1966 | Minks | 336/83 |
| 4,409,523 | 10/1983 | Yasumura | 315/371 |
| 4,914,561 | 4/1990 | Rice et al. | 336/200 |
| 4,943,793 | 7/1990 | Ngo et al. | 336/212 |
| 4,959,630 | 9/1990 | Yerman et al. | 336/200 |
| 4,959,631 | 9/1990 | Hasegawa et al. | 336/200 |
| 5,017,902 | 5/1991 | Yerman et al. | 336/200 |

FOREIGN PATENT DOCUMENTS

| | | | |
|---|---|---|---|
| 0388930 | 9/1990 | European Pat. Off. . | |
| 0444522 | 9/1991 | European Pat. Off. . | |
| 47-41687 | 12/1968 | Japan | 336/178 |
| 1027685 | 3/1966 | United Kingdom | 336/178 |
| 1180923 | 2/1970 | United Kingdom . | |
| 1341038 | 12/1973 | United Kingdom | 336/178 |
| 2252208 | 1/1991 | United Kingdom . | |

OTHER PUBLICATIONS

"Planar Magnetics Lower Profile, Improve Converter Efficiency", Estrov, (PCJM) vol. 15, No. 5, May 1989, p. 16.

"Voltage Resonant Buck-Boost Converter Using Multi-Layer-Winding Transformer", Shoyama et a l. CH2721-9/89/0000-0595, 1989, IEEE, pp. 895-901.

*Primary Examiner*—Thomas J. Kozma

*Attorney, Agent, or Firm*—J. M. Breedlove; W. H. Meise; C. A. Berard

[57] ABSTRACT

A multi-pole magnetic component, such as an inductor, includes z-folded conductive film windings and a core having a plurality of pairs of spaced apart core posts extending between a base plate and a top plate of the core. The core includes an air gap that is distributed substantially evenly along the flux path. Magnetic flux flows through the core posts in a series manner so as to have an opposite flux direction in adjacent poles. Preferably, the air gap is determined such that the ratio of the distance between each adjacent core post and the distance between the base and top plates results in magnetic fields that are substantially tangential to the surface of the conductive film winding. Furthermore, the core posts are preferably shaped to have a larger cross sectional area at the base portion of the posts than at the top portion thereof. Alternatively, the core posts are attached to the bottom plate and are inserted into suitably shaped cut-out portions of the top plate. In either case, the air gap between each core post and the respective core plate is smaller around the center of the core post than at the outer edges thereof. As a result, flux is concentrated near the center of the core posts, thereby reducing fringing fields which, in turn, minimizes high-frequency winding losses.

13 Claims, 8 Drawing Sheets

HIGH-FREQUENCY, LOW-PROFILE INDUCTOR

RELATED APPLICATIONS

This application is related to commonly assigned, U.S. patent application Ser. No. 838,958, now U.S. Pat. No. 5,291,173, issued Mar. 1, 1994 in the name of Yerman et al. of A. J. Yerman and W. A. Roshen and to commonly assigned, copending U.S. application Ser. No. 07/838,953, filed Feb. 21, 1992 in the name of Roshen et al. of W. A. Roshen, A. J. Yerman and G. S. Claydon, both filed concurrently herewith and incorporated by reference herein.

1. Field of the Invention

The present invention relates generally to magnetic circuit components and, more particularly, to a multi-pole core structure with a distributed air gap for a high-frequency, low-profile inductor.

2. Background of the Invention

The size of magnetic components is a significant factor in determining the height and power density of a power supply. Exemplary low-profile magnetic circuit components have conductive film windings. For example, a low-profile, conductive film transformer having a multi-pole core and a conductive film winding is described in commonly assigned, copending U.S. Patent of A. J. Yerman and W. A. Roshen, U.S. Pat. No. 5,126,715, issued Jun. 30, 1992 in the name Yerman et al. and incorporated by reference herein. In particular, a transformer according to U.S. Pat. No. 5,126,715, issued Jun. 30, 1992 in the name of Yerman et al. includes a continuous, serpentine primary winding that is configured and z-folded to form a multi-layer winding having separate secondary winding layers interleaved therewith. Conductive connecting strips are used to electrically connect the separate secondary winding layers together. In another commonly assigned, copending U.S. patent application of A. J. Yerman and W. A. Roshen, U.S. Pat. No. 5,291,173, issued Mar. 1, 1994 in the name of Yerman et al. cited hereinabove, a continuous, z-foldable secondary winding configuration is described that allows for very simple and reliable high-current and low-resistance connections between secondary winding layers. Still another commonly assigned, copending U.S. patent application of W. A. Roshen, A. J. Yerman and G. S. Claydon, abandoned application Ser. No. 07/838,953, filed Feb. 21, 1992 in the name of Roshen et al., cited hereinabove, describes a continuous, center-tapped, z-foldable secondary winding.

Conductive film windings such as those described hereinabove significantly reduce the size of magnetic circuit components and exhibit low winding losses at high frequencies. However, most high-frequency power circuits also require magnetic components with low inductance values, e.g., resonant inductors. To obtain a low inductance value, the effective permeability of the core must be less than about ten. For such components, however, core losses are a problem because most of the commercially available magnetic materials are very inefficient at high frequencies. Typically, the specific losses per unit volume of low-permeability magnetic materials are an order of magnitude higher than those of high-permeability magnetic materials at high frequencies, for example, in the 0.5 to 5 MHz frequency range.

An alternative approach to achieving a low effective permeability is to use a highly efficient high-permeability material in combination with an air gap. However, such an air gap results in substantial fringing fields, causing high winding losses as well as high core losses due to non-uniform flux at the edges near the gap. Still another approach is to distribute the air gap by providing multiple gaps around the length of a high-permeability core, e.g., a toroidal core. Such distributed gap cores, however, do not meet the low height requirement for low-profile, high power density applications.

Accordingly, it is desirable to provide a multi-pole core structure for a magnetic component having an air gap that is distributed substantially evenly along the flux path in order to reduce winding and core losses.

SUMMARY OF THE INVENTION

A multi-pole magnetic component, such as an inductor, includes z-folded conductive film windings and a core having a plurality of pairs of spaced apart core posts extending between a base plate and a top plate of the core. The core includes an air gap that is distributed substantially evenly along the flux path. Magnetic flux flows through the core posts in a series manner so as to have an opposite flux direction in adjacent poles. In one embodiment, the core posts are situated on the bottom plate such that the distance between each core post and the top plate is substantially the same. In another embodiment, there are corresponding core posts spaced apart from each other on the top and bottom plates of the core. And, in a third embodiment, diagonally opposed core posts on both the top and bottom plates of the core are situated such that the distance between each core post and the respective opposite core plate is substantially the same. Preferably, the air gap of a magnetic core according to the present invention is determined such that the ratio of the distance between each adjacent core post and the distance between the base and top plates results in magnetic fields that are substantially tangential to the surface of the conductive film winding.

Furthermore, the core posts are preferably shaped to have a larger cross sectional area at the base portion of the posts than at the top portion thereof. Alternatively, the core posts are attached to the bottom plate and are inserted into suitably shaped cut-out portions of the top plate. In either case, the air gap between each core post and the respective core plate is smaller around the center of the core post than at the outer edges thereof. As a result, flux is concentrated near the center of the core posts, thereby reducing fringing fields which, in turn, minimizes high-frequency winding losses.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1A:
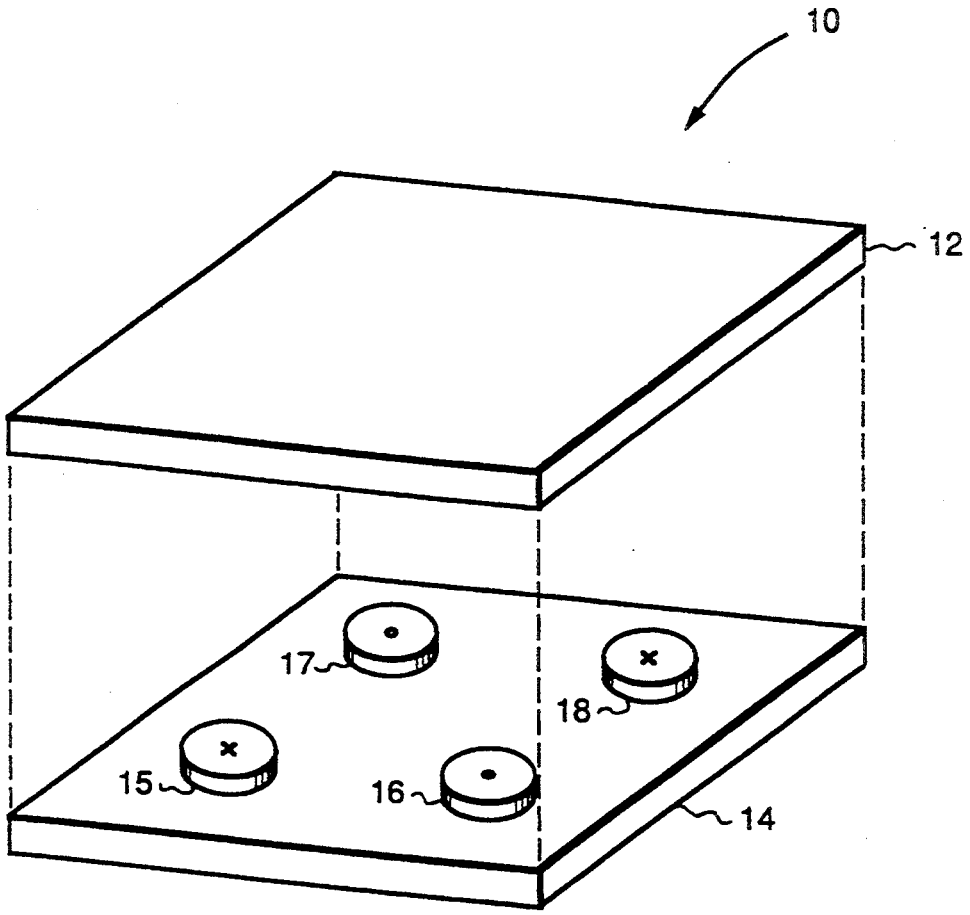
FIG. 1*a* is an exploded, perspective view illustrating a magnetic core according to one embodiment of the present invention.
Figure 1B:
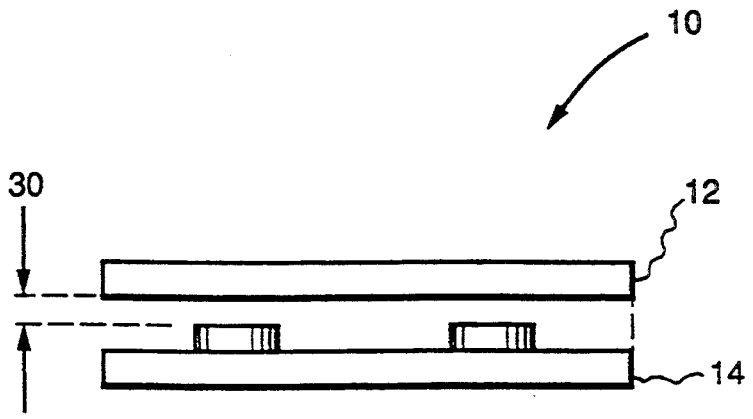
FIG. 1*b* is a side view of the magnetic core of FIG. 1*a* illustrating an exemplary air gap after assembly of the core.
Figure 2:
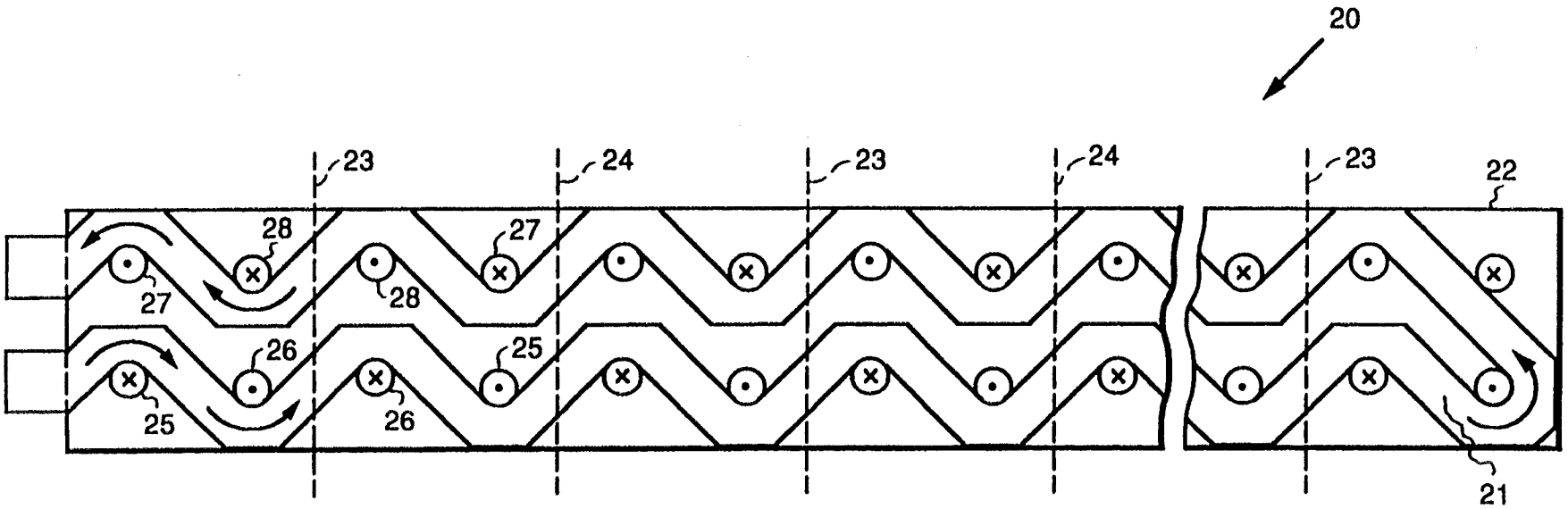
FIG. 2 is a top, plan view of a conductive film winding useful in an magnetic component according to the present invention.

FIG. 1*a* illustrates a multi-pole core structure for a magnetic component according to the present invention. By way of illustration, FIG. 1*a* illustrates a magnetic core 10 having a top plate 12, a base plate 14, and four core posts 15–18 extending therebetween. Specifically, core posts 15–18 correspond to four magnetic poles. However, those of ordinary skill in the art will appreciate that the principles of the core structure of the present invention are not limited to four poles, but apply to any plurality of pairs of spaced apart magnetic poles. Core 10 is constructed from a high-permeability magnetic material, exemplary high-permeability materials being manganese-zinc ferrites such as type pc50 manufactured by TDK Corporation, type K2 manufactured by Magnetics, Inc., type N47 manufactured by Siemens, or type KB5 manufactured by Krystinel Corporation. Core 10 is suitable for containing at least one conductive film winding, such as winding 20 of FIG. 2. For example, winding 20 is of a type described in U.S. patent application Ser. No. 07/548,461, cited hereinabove, having a conductive film 21 disposed on a dielectric membrane 22 which is z-folded along fold lines 23 and 24 and inserted into core 10 so that the corresponding openings for magnetic poles 25–28 receive core posts 15–18, respectively. As illustrated in FIG. 1*b*, top plate 12 is situated such that there is a predetermined air gap 30 between the tops of core posts 15–18 and top plate 12.

Magnetic flux flows through core posts 15–18 in a series manner, resulting in an opposite flux direction in adjacent poles. (By way of illustration, in conventional manner, X's are provided within poles 15 and 18 to indicate that the direction of magnetic flux therein extends downward, and dots are provided within poles 16 and 17 to indicate that the direction of magnetic flux therein extends upward.) Therefore, in accordance with the present invention, air gap 30 between the core posts and the top plate is distributed substantially evenly along the flux path.

Furthermore, the air gap of a magnetic core according to the present invention is preferably determined such that the ratio of the distance between each adjacent core post and the distance between the base and top plates results in magnetic fields that are substantially tangential to the surface of the conductive film winding. In this way, high-frequency winding losses are minimized. The optimum ratio depends on the total effective air gap. A preferred ratio is in the range from approximately 0.5 to 5.0, with a more preferred range being from approximately 1.0 to 3.0. An exemplary ratio is approximately 2.5.

Figure 3:
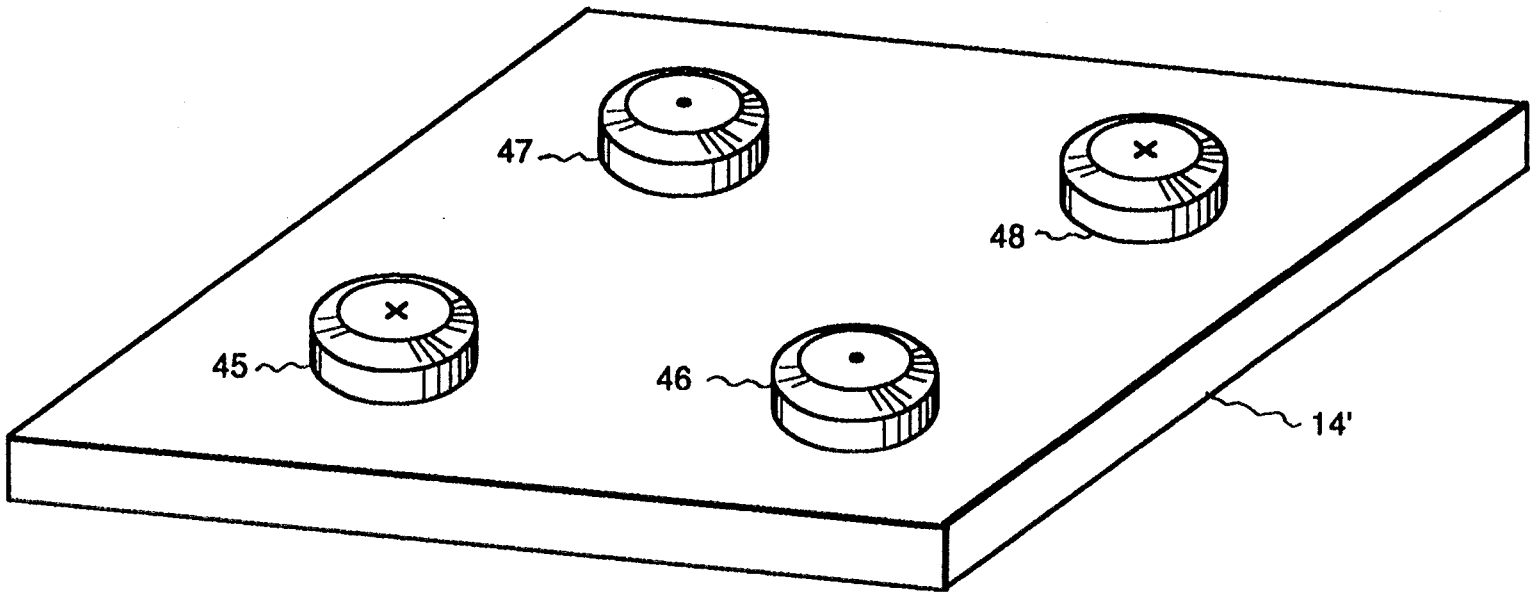
FIG. 3 is a perspective view illustrating an alternative embodiment of the bottom plate of an improved core structure for a magnetic component according to the present invention.

FIG. 3 illustrates an alternative embodiment of the bottom plate of a magnetic core according to the present invention wherein core posts 45–48 are suitably shaped to have a larger cross sectional area at the base than at top portions thereof. In this way, the air gap between the core posts and top plate is smaller at and around the center of the core posts than at the outer edges thereof. As a result, flux is concentrated near the center of the core posts, thereby reducing fringing fields which, in turn, minimizes high-frequency winding losses.

Figure 4B:
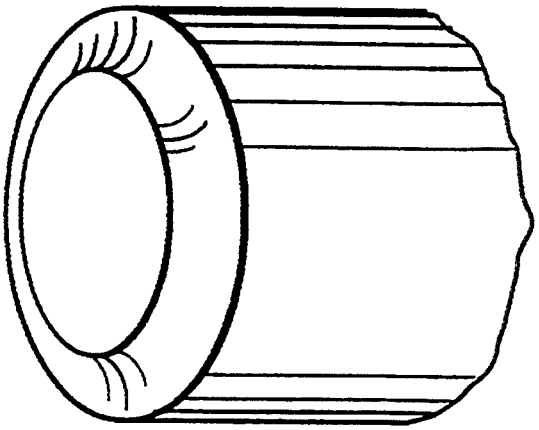
FIGS. 4*a* and 4*b* illustrate alternative embodiments of core posts for use in the improved core structure of the present invention.
Figure 4A:
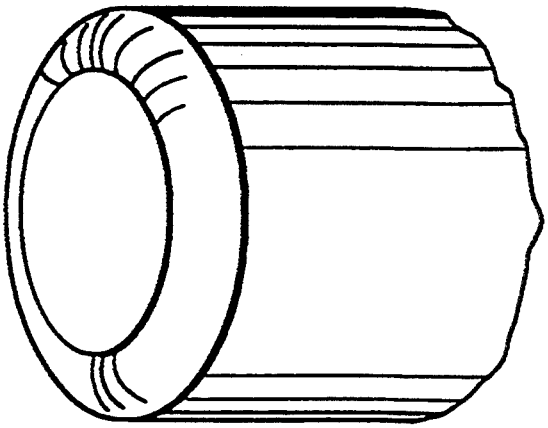

FIGS. 4*a* and 4*b* illustrate alternative embodiments of core posts useful in a magnetic core according to the present invention. As shown, the top portion of each core post has a smaller cross sectional area than that of its base portion in order to reduce fringing fields, as described hereinabove. Furthermore, the top portion of the core post of FIG. 4*a* has rounded edges, while the edges of the core post of FIG. 4*b* extend inwardly. Advantageously, the core post of FIG. 4*b* exhibits the lowest concentration of fringing fields. However, the core posts of FIGS. 3 and 4*a* are easier to fabricate.

Figure 5A:
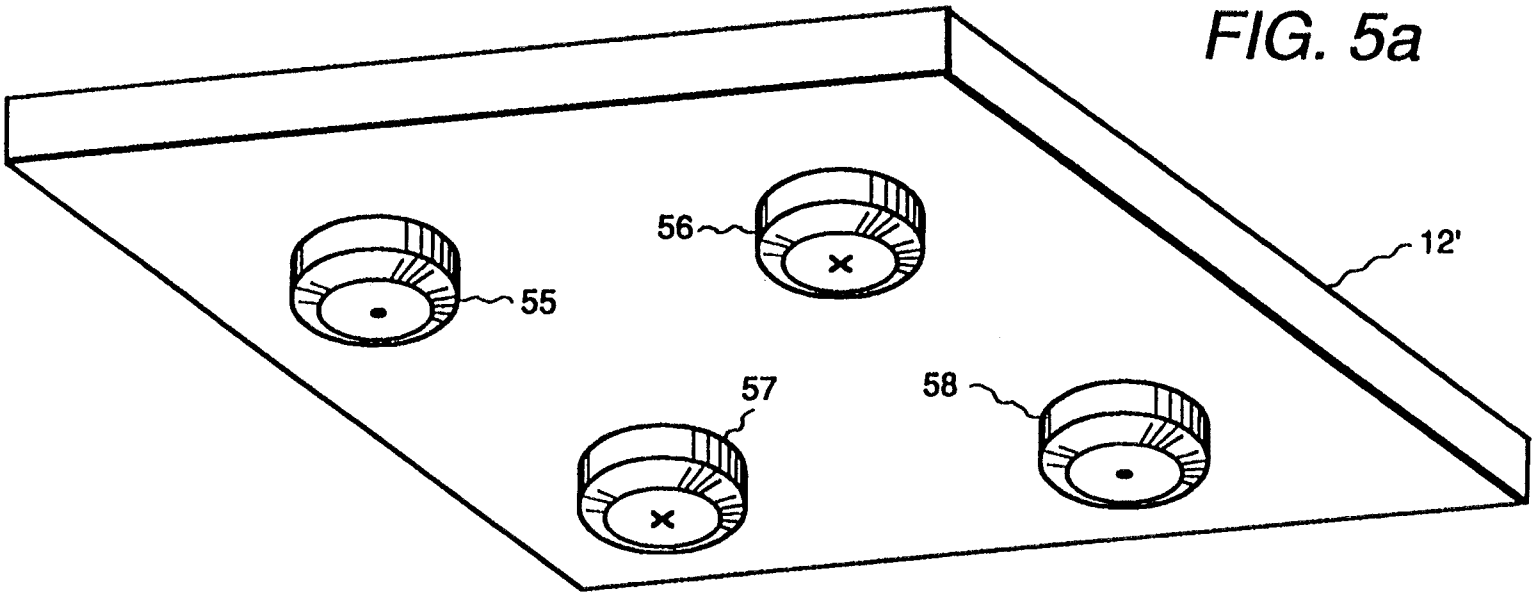
FIG. 5*a* is a perspective view of an alternative embodiment of a top plate useful with the bottom plate of FIG. 3.
Figure 5B:
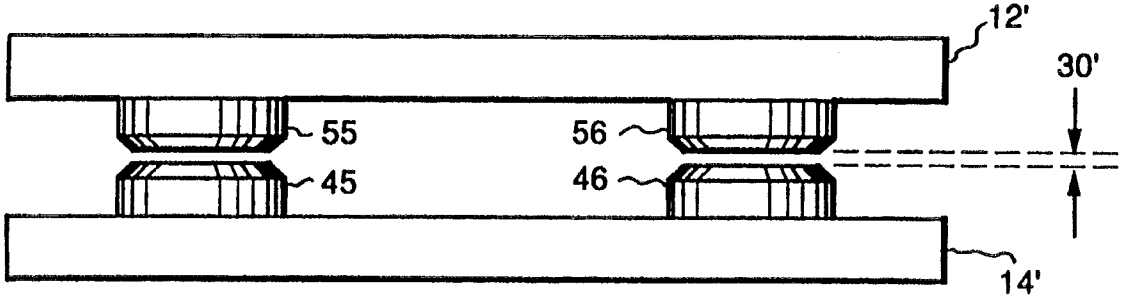
FIG. 5*b* is a side view of a magnetic core according to the present invention including the top plate of FIG. 5*a* and the bottom plate of FIG. 3.

FIG. 5 illustrates another alternative embodiment of a magnetic core according to the present invention. In particular, the core of FIG. 5 has corresponding core posts on the top and bottom plates thereof. Specifically, core posts 55–58 of top plate 12' are respectively situated opposite from the core posts 45–48 extending from bottom plate 14' (FIG. 3). The total effective air gap, which is concentrated toward the center of the core posts to reduce fringing fields, is distributed substantially evenly along the flux path, minimizing the height and losses of the core in accordance with the present invention.

Figure 6A:
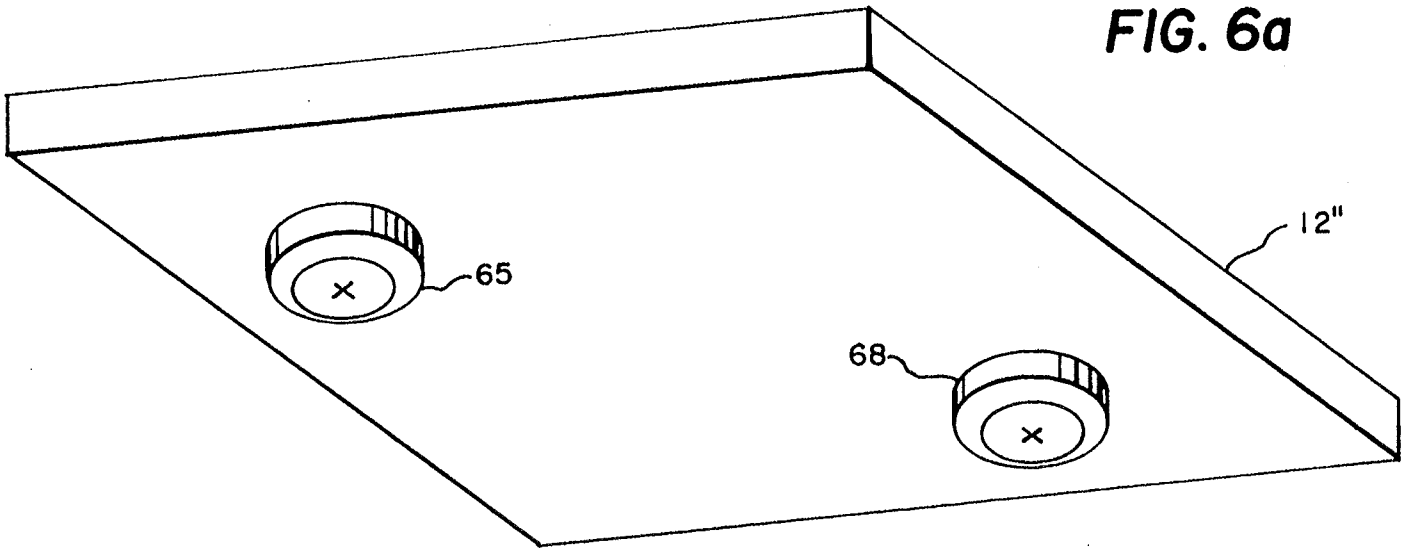
FIG. 6*a* is a perspective view of an alternative embodiment of a top plate of a magnetic core according to the present invention.
Figure 6C:
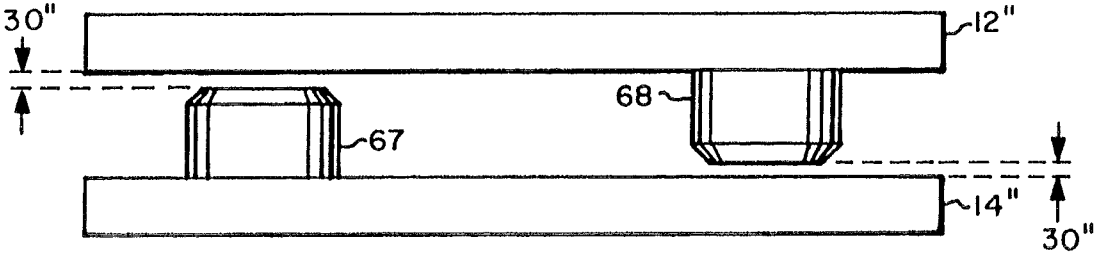
FIG. 6*c* is a side view of a magnetic core having a top plate such as that of FIG. 6*a* and a bottom plate such as that of FIG. 6*b*.
Figure 6B:
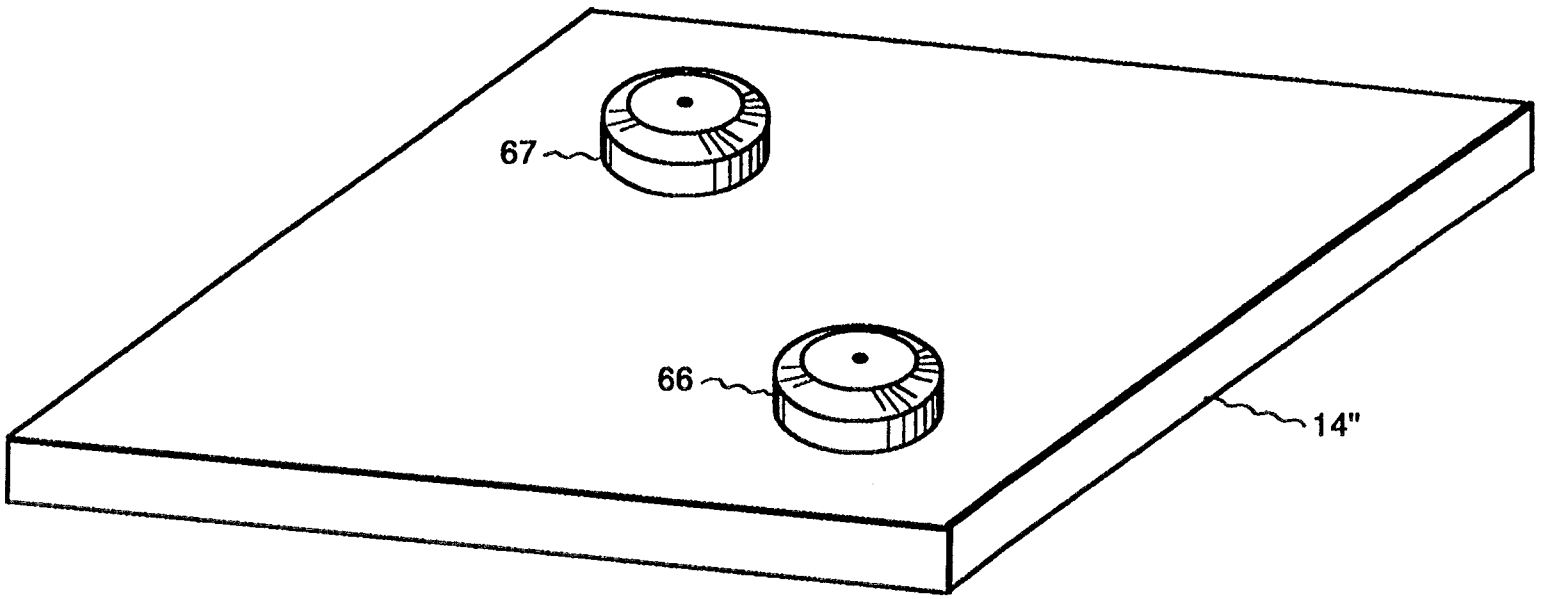
FIG. 6*b* is a perspective view of a bottom plate useful with the top plate of FIG. 6*a;*

FIG. 6 illustrates another alternative embodiment of a magnetic core according to the present invention wherein the top and bottom plates 12" and 14", respectively, each have a pair of diagonally opposed core posts, each core post being separated from the respective opposite plate by a gap 30". The total effective air gap is thus distributed substantially evenly along the flux path. Moreover, the distance between each air gap (i.e., between each core post and the respective opposite plate) is substantially the same, further reducing fringing fields and the associated winding and core losses.

Figure 7B:
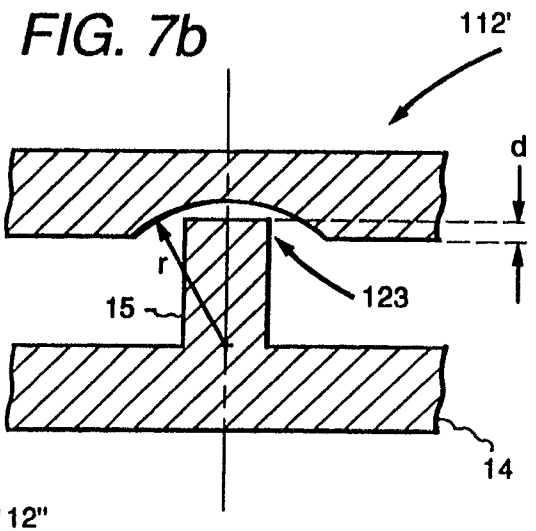
FIGS. 7*a*–7*c* are cross sectional side views of yet additional alternative embodiments of the magnetic core of the present invention.
Figure 7A:
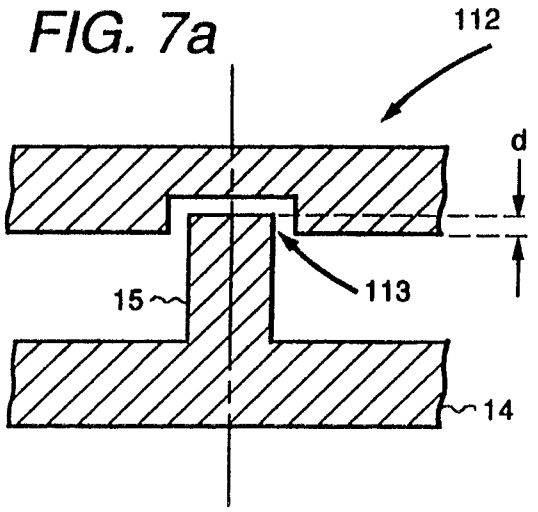
Figure 7C:
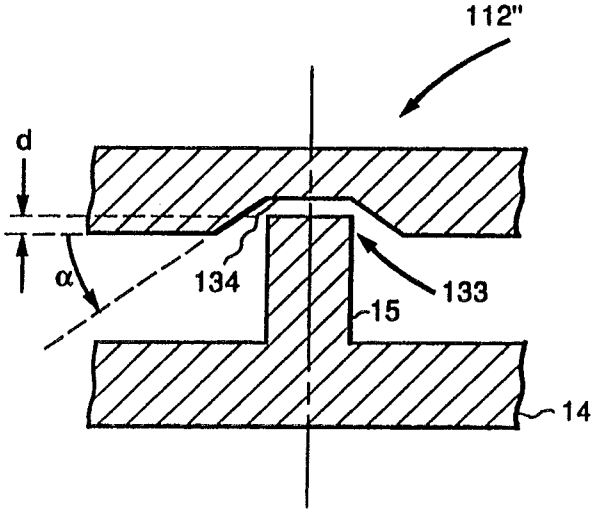

FIGS. 7*a*–7*c* illustrate still other alternative embodiments of the present invention wherein the core posts are configured to have a uniform shape, such as core posts 15–18 of FIG. 1, and the top plate of the core has cut-out portions corresponding to the core posts. The posts are disposed to a certain depth d within the respective cut-out portions such that there is a predetermined gap between each core post and the top plate. For example, FIG. 7*a* shows a top plate 112 having a cut-out portion 113 corresponding to the shape of core post 15. In FIG. 7*b*, the cut-out portion 123 of top plate 112' comprises a portion of a sphere having a radius r. And, in FIG. 7*c*, the cut-out portion 133 of top plate 112" has straight sides that flare out at an angle $\alpha$ from a flat portion 134.

In yet other alternative embodiments, the core posts are suitably shaped (such as those of FIGS. 1 and 3–4) and the respective core plates have suitably shaped cutout portions (such as those of FIGS. *7a–7c*) in order to reduce fringing fields and hence winding losses.

Although the gaps in the magnetic cores have been illustrated and described herein as comprising air gaps, those of ordinary skill in the art will appreciate that the air gaps may be realized using-suitable low-permeability materials, such as, for example, Kapton polyimide film manufactured by E. I. du Pont de Nemours and Company.

Furthermore, although the magnetic cores have been described herein with particular reference to inductor cores, those of ordinary skill in the art will appreciate that such cores are also suitable for use in certain types of transformers that function both as inductors and transformers.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A low-profile magnetic component, comprising:

a Z-folded film including an elongated dielectric film defining first and second ends and a length dimension between said ends, and first and second edges, said dielectric film having a predetermined width between said first and second edges, said dielectric film supporting an electrical conductor having at least a first portion defining a second width which is less than said predetermined width, said first portion of said electrical conductor extending in a zig-zag manner from said first end of said dielectric film to a location near said second end of said dielectric film, said elongated dielectric film also defining a plurality of pairs of core apertures, each said pair of core apertures including first and second core apertures spaced apart from each other and from said first and second edges of said dielectric film, said pairs of first and second core apertures being spaced in a regular pattern along said length of said dielectric film, said regular pattern being selected so that, when said dielectric film is Z-folded to form said Z-folded film, said first and second core apertures of each of said pairs of core apertures are registered with corresponding ones of said first and second core apertures of the other pairs of core apertures, said first core apertures of each of said pairs of core apertures being located adjacent said first portion of said electrical conductor, and between said first portion of said electrical conductor and said first edge of said dielectric film, and said second core apertures of each of said pairs of core apertures being located adjacent said first portion of said electrical conductor, and between said first portion of said electrical conductor and said second edge of said dielectric film;

a thin, fiat, magnetically permeable top plate defining at least one peripheral edge;

a thin, fiat, magnetically permeable bottom plate defining at least one peripheral edge, and lying substantially parallel to, and spaced away from said first plate by a predetermined separation;

a first magnetically permeable core post having a length less than said predetermined separation, and extending through said first core apertures of said Z-folded film, and between said top and bottom plates, so as to be magnetically coupled to said top and bottom plates at first locations spaced away from said peripheral edges of said top and bottom plates, whereby said first core post is magnetically coupled to said top and bottom plates by a magnetic path including a first gap resulting from the difference between said predetermined separation and said length of said first core post;

a second magnetically permeable core post having a length less than said predetermined separation, and extending through said second core apertures of said Z-folded film, and between said top and bottom plates, so as to be magnetically coupled to said top and bottom plates at second locations spaced away from said peripheral edges of said top and bottom plates, whereby said second core post is magnetically coupled to said top and bottom plates by a magnetic path including a second gap resulting from the difference between said predetermined separation and said length of said second core post;

whereby, when electrical current flows through said first portion of said electrical conductor, the magnetic flux direction through said first and second apertures, and through said first and second core posts, respectively, extending therethrough, is mutually parallel but oppositely directed.

2. A magnetic component according to claim 1 wherein said first and second gaps have equal dimensions.

3. A magnetic component according to claim 1, wherein each of said core posts has a circular transverse cross-section, and the diameter of said first and second core posts adjacent said first and second gaps, respectively, is smaller than the diameters of said first and second core posts at locations remote from said first and second gaps, respectively.

4. A magnetic component according to claim 1, wherein said first core post is bipartite, with said first gap centered between first and second portions of said first core post, and said second core post is also bipartite, with said second gap centered between first and second portions of said second core post.

5. A magnetic component according to claim 1, wherein:

said first portion of said electrical conductor has said second width which is less than half said predetermined width of said dielectric film, and said first portion of said electrical conductor extends in said zig-zag manner adjacent said first edge of said dielectric film to a location near said second end of said dielectric film, and said Z-folded film includes a second portion of said electrical conductor which returns to said first end in a zig-zag manner nearer to said second edge of said dielectric film than said first portion of said conductor;

said elongated dielectric film further defining a plurality of couples of core apertures, each of said couples of core apertures including third and fourth core apertures spaced apart from each other and from said first and second edges of said dielectric film, said couples of third and fourth core apertures being spaced in said regular pattern along said length of said dielectric film, said regular pattern being selected so that, when said dielectric film is Z-folded to form said Z-folded film, said third and fourth core apertures of each of said couples of core apertures are registered with corresponding ones of said third and fourth core apertures of the other couples of core apertures, said third core apertures of each of said couples of core apertures being located adjacent said second portion of said electrical conductor, and between said second portion of said electrical conductor and said first edge of said dielectric film, and said second core apertures of each of said sets of core apertures being located adjacent said second portion of said electrical conductor, and between said second portion of said electrical conductor and said second edge of said dielectric film, said first, second, third and fourth core apertures being located at the corners of a square; and a third magnetically permeable core post having a length less than said predetermined separation, and extending through said third core apertures of said Z-folded film, and between said top and bottom plates, so as to be magnetically coupled to said top and bottom plates at third locations spaced away from said peripheral edges of said top and bottom plates, whereby said third core post is magnetically coupled to said top and bottom plates by a magnetic path including a third gap resulting from the difference between said predetermined separation and said length of said third core post; and a fourth magnetically permeable core post having a length less than said predetermined separation, and extending through said fourth core apertures of said Z-folded film, and between said top and bottom plates, so as to be magnetically coupled to said top and bottom plates at fourth locations spaced away from said edges of said top and bottom plates, whereby said fourth core post is magnetically coupled to said top and bottom plates by a magnetic path including a fourth gap resulting from the difference between said predetermined separation and said length of said fourth core post;

whereby, when electrical current flows serially through said first and second portions of said electrical conductor, the magnetic flux direction through said first and fourth apertures, and through said first and fourth core posts, respectively, extending therethrough, is mutually parallel and directed in a first direction, and the magnetic flux direction through said second and third apertures, and through said second and third core posts, respectively, extending therethrough, is parallel to said magnetic flux direction through said first and fourth core posts, but directed in a second direction, opposite to said first direction.

6. A magnetic component according to claim 5, wherein said first, second, third and fourth gaps have equal dimensions.

7. A magnetic component according to claim 5, wherein each of said core posts has a circular transverse cross-section, and the diameters of said first, second, third, and fourth core posts adjacent said first, second, third and fourth gaps, respectively, is smaller than the diameters of said first, second, third, and fourth core posts at locations remote from said first, second, third, and fourth gaps, respectively.

8. A magnetic component according to claim 7, wherein said first, second, third and fourth gaps have equal dimensions.

9. A magnetic component according to claim 5, wherein said electrical conductor is a film electrical conductor.

10. A magnetic component according to claim 5, wherein said first core post is bipartite, with said first gap centered between first and second portions of said first core post, said second core post is bipartite, with said second gap centered between first and second portions of said second core post, said third core post is bipartite, with said third gap centered between first and second portions of said third core post, and said fourth core post is also bipartite, with said fourth gap centered between first and second portions of said fourth core post.

11. A magnetic component according to claim 5, wherein the ratio of the distance between adjacent ones of said core posts and said predetermined separation between said top and bottom plates is in the range from approximately $\frac{1}{2}$ to 5.

12. A magnetic component according to claim 11, wherein said ratio is in the range from approximately 1 to 3.

13. A magnetic component according to claim 12, wherein said ratio is $2\frac{1}{2}$.

* * * * *